US007407700B2

(12) United States Patent
Kishida et al.

(10) Patent No.: US 7,407,700 B2
(45) Date of Patent: Aug. 5, 2008

(54) COATED PAPER FOR PRINTING

(75) Inventors: Takayuki Kishida, Amagasaki (JP); Yoshiki Kojima, Amagasaki (JP); Nobuo Yamada, Amagasaki (JP); Yasuhiro Arai, Amagasaki (JP); Tetsuya Hirabayashi, Amagasaki (JP)

(73) Assignee: Oji Paper Co., Ltd., Tokyo (JP)

( * ) Notice: Subject to any disclaimer, the term of this patent is extended or adjusted under 35 U.S.C. 154(b) by 0 days.

(21) Appl. No.: 10/553,789

(22) PCT Filed: Oct. 20, 2005

(86) PCT No.: PCT/JP2004/005847

§ 371 (c)(1),
(2), (4) Date: Sep. 16, 2006

(87) PCT Pub. No.: WO2004/094725

PCT Pub. Date: Nov. 4, 2004

(65) Prior Publication Data

US 2007/0048508 A1 Mar. 1, 2007

(30) Foreign Application Priority Data

Apr. 24, 2003 (JP) ..... 2003-119541

(51) Int. Cl.
*B32B 3/00* (2006.01)

(52) U.S. Cl. ..... 428/195; 428/503; 347/102; 347/105

(58) Field of Classification Search ..... 428/32.28, 428/195, 503; 347/102, 105, 103
See application file for complete search history.

(56) References Cited

U.S. PATENT DOCUMENTS

| | | | | |
|---|---|---|---|---|
| 5,789,031 | A * | 8/1998 | Hirabayashi et al. | 427/341 |
| 6,458,413 | B1 * | 10/2002 | Hirabayashi et al. | 427/209 |
| 6,582,047 | B2 * | 6/2003 | Koitabashi et al. | 347/16 |
| 6,902,794 | B2 * | 6/2005 | Hirabayashi et al. | 428/195.1 |
| 2005/0170110 | A1 | 8/2005 | Wakai et al. | |

FOREIGN PATENT DOCUMENTS

| | | |
|---|---|---|
| JP | 64-33297 | 2/1989 |
| JP | 2-269897 | 11/1990 |
| JP | 6-65898 | 3/1994 |
| JP | 6-280197 | 10/1994 |
| JP | 6-346400 | 12/1994 |
| JP | 9-67796 | 3/1997 |
| JP | 2000-119994 | 4/2000 |
| JP | 2000-256990 | 9/2000 |
| JP | 2000-265396 | 9/2000 |
| JP | 2001-254295 | 9/2001 |
| JP | 2002-146697 | 5/2002 |
| JP | 2002-294589 | 10/2002 |
| JP | 2002-363884 | 12/2002 |

* cited by examiner

*Primary Examiner*—Leszek Kiliman
(74) *Attorney, Agent, or Firm*—Michael J. Striker

(57) ABSTRACT

A coated paper is white and glossy enough to give satisfaction as a printing paper, exhibits a good printability in offset sheet-fed printing and a high printing gloss, and does not degrade the print efficiency. The coated paper is characterized by having two or more coating layers composed mainly of a pigment and an adhesive on at least one side of a base paper. When ink is transferred onto the paper, the ink settability is relatively low in the early stage of the drying process and relatively high in the final stage.

8 Claims, No Drawings

COATED PAPER FOR PRINTING

FIELD OF THE INVENTION

The present invention relates to a coated paper for printing with satisfactory white glossiness, printability suitable for offset sheet-fed printing, and a good ink gloss.

BACKGROUND OF THE INVENTION

In general, a coated paper for printing is prepared by applying coating layers composed mainly of a pigment and an adhesive on one side or both sides of a base paper. Such a coated paper for printing is classified into, for example, a cast-coat paper, an art paper, a coated paper, or a slight coated paper in accordance with the composition of coating layer, or the finishing process of a coated paper. Those coated papers applied with polychromatic or monochromatic printing processes have been widely used for commercial printed matter such as advertising leaflets, pamphlets, or posters, or for publications such as books or magazines. In recent years, a trend toward visualization and colorization of printed matter is in progress, which has increased demand for a high quality coated paper for printing with appropriate characteristics. Specifically, the level of printing gloss (ink gloss) after printing is emphasized.

When a small lot of commercial printed matter is prepared, an offset sheet-fed printing in which a sheet of coated paper is printed one by one is often used. However, it seems difficult for an offset printing to achieve a high ink gloss while improving the print efficiency by refining a coated paper for printing. When the ink settability (absorption of printing ink) increases, the drying rate of ink transferred onto a coated paper also increases, which improves printing efficiency. However, an increase of the ink settability of a coated paper for printing usually results in decreased printing gloss due to the following reasons:

In general, the main components of ink used for offset sheet-fed printing are a pigment, resin, solvent (normally, petroleum solvent), and vegetable oil (drying oil, semi-drying oil, etc.). When such an ink is transferred onto a coated paper, the viscosity of the ink increases as solvents in the ink are absorbed in gaps of a coating layer, so that the ink on the paper surface eventually becomes non-sticky (a status in which ink has been set) when a finger touches it. As time passes, the ink set on a paper surface is polymerized as vegetable oil composing the ink responds to oxygen in air so as to form a rigid dry coating film (a status in which ink has been dried). In this status, such an ink film will not be peeled off or damaged if external force is applied to some degree.

Namely, the rate of ink setting mainly relies on the ink settability of a coated paper (absorption ability of ink solvent), and the rate of ink drying mainly relies on composition of the printing ink itself.

Therefore, if the ink settability increases, the ink transferred onto a coated paper can dry sooner. However, in offset printing, the transfer of ink onto a coated paper surface is performed through a blanket cylinder. In particular, as an ink layer transferred onto a surface of a blanket cylinder is pulled out from the blanket cylinder and transferred onto coated paper, the ink layer just transferred onto the coated paper presents a split pattern. If a transferred ink has sufficient flowability, this split pattern will be dissolved to become a smooth pattern over time so as to achieve a good ink gloss. However, in a coated paper with high ink settability, as the flowability of the ink transferred onto such a coated paper can be lost quickly, the ink layer often dries up without dissolving the split pattern, so that it is difficult to obtain printed matter with a high ink gloss.

PRIOR ARTS

In order to obtain a coated paper for printing with a satisfactory printing efficiency and a good ink gloss, one of conventional techniques has proposed the use of fusiform caustic precipitated light carbonate calcium of 60-90 weight % of the total amount of the pigment as pigment components of a coating layer and copolymer latex having an average particle diameter of 50-80 nm and gel content of 30-50% as adhesive components (see Patent Document 1). According to another proposal of conventional techniques, a surface layer is applied on a coating layer of a coated paper in such a manner that the surface layer contains thermoplastic polymer with glass-transition temperature of 80° C. or above, and surface sizing agents (see Patent Document 2).

A coated paper for offset printing having two or more coating layers on at least one surface of a base paper has been proposed, in which latex binder having an average particle diameter of 100-250 nm, and gel content of 60% or less, is used in a bottom coating layer (see Patent Document 3).

In a conventional coated paper for printing which is close to this invention, two or more coating layers are applied on at least one surface of a base paper, in which cumulative void volume and average void diameter of the outermost coating layer are defined within a predetermined range, respectively, while absorption coefficient Ka of standard viscosity oil measured by Bristow tester is defined within a range of 0.35-1.5 $ml/(m^2 \cdot ms^{1/2})$ (see Patent Document 4). In order to achieve high ink gloss, in this coated paper for printing, the ink settability of the coated paper slows down by relatively enlarging the percentage of void of the outermost coating layer, and an excessive delay of the ink settability caused by relatively enlarging the void diameter of the outermost layer is suppressed by relatively lessening the void diameter of the inner coating layer.

However, the void diameter of a coating layer normally relies on the particle diameter of pigment components contained in the coating layer so that it is necessary to use a pigment having large particle diameter in order to enlarge the void diameter. Thereby, in order to enlarge the void diameter of the outermost coating layer, it is impossible to use a fine pigment having a small particle diameter. As a result, in a coated paper for printing proposed in Patent Document 4, the paper glossiness is likely damaged even if calender processing is applied.

In recent years, in the offset printing field, an evaluation method has emerged by which the ink settability of a coated paper which affects the printing gloss is evaluated using the value of ink tackiness (adhesion) (see Non Patent Document 1). In this method, a tack tester is used so that after a predetermined print pattern is transferred to a sample coated paper adhered to an impression cylinder by a print disc under given print conditions, a tack disc is pressed down like a blanket cylinder at a fixed pressure for a period of time, then, the tack (adhesion) between the tack disc and print pattern is measured. The ink tack value measured by a tack tester will increase over time to reach a maximum value.

Then, in general, the maximum value will be maintained for a while and decrease thereafter. The initial gradual increase is correspondent to a gradual increase of ink viscosity caused as solvents in the ink transferred onto a coated paper are absorbed in a coating layer. The gradual decrease thereafter is correspondent to curing of the transferred ink caused as solvents are vaporized and oxidative polymerized.

Although the variation of ink tack, which changes over the time, is determined by the ink composition, it relies on the quality of the ink settability of a coated paper, in particular, the void structure of a coating layer.

A coated paper in which the ink settability of the coated paper is adjusted by the value of ink tack which changes over the time has been conventionally proposed to obtain a mat-finish coated paper for printing achieving high print gloss (see Patent Document 5). This mat-finish coated paper aims to achieve high printing gloss by suppressing the sharp increase of the tack value of the ink transferred onto a coated paper by printing, in other words, by suppressing the ink set property of a coated paper. However, as explained above, a coated paper with low ink settability will likely cause damage in printing efficiency, and Patent Document 5 does not offer any solution for this disadvantage.

CITED REFERENCES

Patent Document 1: Unexamined Patent Publication No. 2000-256990

Patent Document 2: Unexamined Patent Publication No. 2002-363884

Patent Document 3: Unexamined Patent Publication No. 2002-146697

Patent Document 4: Unexamined Patent Publication No. 2001-254295

Patent Document 5: Unexamined Patent Publication No. 2002-294589

Non Patent Document 1: International Printing and Graphic Arts Conference, 1994, pp 209-228

One of the objects of the present invention is to provide a coated paper for printing that has satisfactory paper glossiness as a paper for printing, printability suitable for offset sheet-fed printing, and a good printing gloss without sacrificing print efficiency.

SUMMARY OF THE INVENTION

According to one aspect of the invention, there is provided a coated paper for printing applying two or more coating layers composed mainly of a pigment and an adhesive on at least one surface of a base paper, wherein absorption coefficient Ka of the coating layers is within a range of 0.02-0.35 $ml/(m^2 \cdot ms^{1/2})$ when measured using Bristow tester and standard viscosity oil (JS2.5) defined in JIS Z8809-1992 as evaluation liquid, wherein ink is prepared by blending sheet ink for evaluating paper of 80 mass % and ink solvent of 20 mass % so as to print on the coating layers on condition that printing pressure is 100N and the amount of transferred ink is 2.3±0.1 $g/m^2$, wherein the maximum value of ink tack can be measured between 24.5 seconds and 790.2 seconds after printing has been performed, wherein an ink tack value measured 24.5 seconds after printing has been performed is 3N or less and ink tack an value measured 790.2 seconds after printing has been performed is 4N or less.

It is more preferable for a coated paper if such ink tack value measured 24.5 seconds after printing has been performed is 2.5N or less and an ink tack value measured 669.6 seconds after printing has been performed is 3N or less.

According to another aspect of the invention, there is provided a coated paper for printing applying two or more coating layers composed mainly of a pigment and an adhesive on at least one surface of a base paper, wherein absorption coefficient Ka of the coating layers is within a range of 0.02-0.35 $ml/(m^2 \cdot ms^{1/2})$ when measured using standard viscosity oil (JS2.5) defined in JIS Z8809-1992 as evaluation liquid and Bristow tester, and wherein, when set-off density is measured by a RI printability tester after printing on the coated paper with sheet ink for evaluating paper on condition that printing pressure is 980N and the amount of transferred ink is 4.2±0.1 $g/m^2$—is evaluated with a 256 gradation, the set-off density 1 minute after printing is 30 or less and the set-off density 6 minutes after printing is 230 or greater.

It is more preferable for a coated paper if such set-off density 1 minute after printing is 28 or less, 3 minutes after printing is 200 or greater, and 6 minutes after printing is 245 or greater.

As explained above, according to the present invention, there is provided a coated paper for printing applying two or more coating layers composed mainly of a pigment and an adhesive on at least one surface of a base paper, wherein pigment components of the outermost layer are composed of calcium carbonate of 5-70 mass % having an average particle diameter of 0.3-1.2 μm and kaolin of 30-95 mass % having an average particle diameter of 0.1-0.4 μm, and adhesive components of the outermost layer are composed of (a) water soluble adhesive, (b) styrene-butadiene copolymer latex containing acrylonitrile of 10-35 mass % in the ratio of monomer and having an average diameter of 50-120 nm, and (c) copolymer latex other than the above (b), wherein when an amount of each of the above (a), (b), and (c) contained in the coating layer is denoted as (S) mass parts, (L1) mass parts, and (L2) mass parts based on 100 mass parts of pigment components of the coating layer, respectively, the value of A can be obtained by the following equation:

$$A(\text{mass part})=2\times(S)+1.5\times(L1)+1\times(L2)$$

Wherein, $0 \leqq (S) < 6$, $0 \leqq (L1)$, $0 \leqq (L2)$, $$(S)+(L1)+(L2) \leqq 16$$

wherein an amount of pigment components having an average particle diameter of 0.4 μm or less contained in the outermost layer is (i) 60 mass % or less of the total amount of pigment components, the value of A is within a range of 16-21, (ii) more than 60 mass % of the total amount of pigment components, the value of A is within a range of 19-24, wherein 80-100 mass % of pigment components of an inner coating layer abutting on the outermost coating layer is composed of calcium carbonate having an average particle diameter of 0.1-1.2 μm while the mixture amount of adhesive components of the coating layer is 6-13 mass parts based on 100 mass parts of pigment components and the amount of water soluble adhesive contained in adhesive components is less than 6 mass parts based on 100 mass parts of pigment components.

BEST MODE FOR CARRYING OUT THE INVENTION

A coated paper for printing of the invention is white and glossy enough to give satisfaction as a printing paper, comprises a coating layer providing the ink settability (absorption ability of ink solvent) capable of achieving a good printing gloss and improving the print efficiency when used in offset printing. Such a coated paper can be obtained by applying two or more coating layers on at least one side of a base paper, wherein a kind and an amount of pigment components and/or adhesives used in each of the outermost coating layer and an inner coating layer abutted on this outermost layer are determined so that the outermost layer contains fine pigment components for obtaining whiteness and gloss good enough to give satisfaction as a printing paper, wherein the ink settability of the outermost coating layer is relatively suppressed while the ink settability of the inner coating layer is relatively increased to compensate suppressed ink settability of the outermost layer so as to achieve a high printing gloss.

Therefore, in this invention, the speed of the ink settability of each of the outermost coating layer and the inner coating layer abutted on the outer layer is extremely important. In this invention, the degree of this ink settability can be defined by an absorption coefficient Ka which is measured by Bristow method, a tack value (adhesion) of the ink measured by an ink tack tester, or set-off density (256 gradation brightness) measured by a RI printability tester.

Not only those particular test methods but also the significance and effect of specifying those methods will be explained hereinafter:

Absorption Coefficient Ka Measured by Bristow Method

In this invention, the ink settability of the outermost coating layer is not controlled by a void diameter produced by pigment particles contained in the outer layer but is controlled by changing the void status of the layer by adhesives contained in the outer coating layer, which is one of features of the invention.

For this reason, a void diameter of the outermost layer may be fine so that fine pigments can be contained in the layer, which is unlikely in prior arts. The void structure status of the surface region of this outermost coating layer can be defined by absorption coefficient Ka measured by Bristow method using standard viscosity oil (JS2.5) defined in JIS Z8809-1992 as evaluation liquid (Patent Document 4).

In a coated paper for printing of the invention, the aforementioned absorption coefficient Ka is in a range of 0.02-0.35 $ml/(m^2 \cdot ms^{1/2})$. This range is smaller than the range of the absorption coefficient Ka of the coated paper {0.35-1.5 $ml/(m^2 \cdot ms^{1/2})$} disclosed in Patent Document 4. This proves that the void diameter of the surface of the outermost coating layer of the invention is smaller than that the outermost coating layer of the coated paper of Patent Document 4.

As it is preferable to blend more fine pigments in the outermost coating layer to provide a coated paper with satisfactory whiteness and gloss as a printing paper, it is more preferable for the above absorption coefficient Ka to be in a range of 0.05-0.15 $ml/(m^2 \cdot ms^{1/2})$.

Ink Tack Value (Adhesion) Measured by Ink Tack Tester

An ink tack value described here is measured under the condition of 23° C. and 50 RH % by using an ink tack tester having the same mechanism as the ink tack test device disclosed in Non-Patent Document 1.

Test ink prepared by combining sheet ink for paper evaluation (trade name: BESTONE SHEET BLACK INK FOR PAPER EVALUATION T&K, TOKA Co., Ltd.) of 80 mass % with ink solvent (trade name: HIZ REDUCER, Dainippon Ink and Chemicals Inc.) of 20 mass % is used for measurement. The ink tack test is performed by printing on a test coated paper with the test ink for 15 minutes under the condition of printing pressure of 100N and an amount of transferred ink of 2.3±0.1 $g/m^2$ by using the ink tack tester.

Ink tack value is measured 24.5 seconds, 669.6 seconds, and 790.2 seconds after printing has been performed, respectively. In addition, the progress of time (sec) is measured for an ink tack value to reach the maximum level after printing has been performed.

As the outermost coating layer of a coated paper is the layer directly receiving ink, the ink settability (ink solvent absorption ability) of this layer determines the ink drying property of the transferred ink during the early stage of the drying process. On the other hand, as the ink solvent absorption ability of an inner coating layer provided under the outermost coating layer is achieved after that of the outermost layer has been achieved, the ink solvent absorption ability of the inner coating layer determines the ink drying property from the middle stage to the final stage of the drying process. Therefore, the level of solvents residing in the transferred ink on a paper surface can be evaluated over time by tracing the change of ink tack value measured by the ink tack tester over the time.

Ink tack value in the early stage of the drying process is inversely proportional to the amount of solvent residing in the transferred ink on the paper surface, that is, the amount of solvent which is not yet absorbed into a coating layer. In other words, if the amount of un-absorbed solvent is large, the ink tack value becomes low and if the amount of un-absorbed solvent is small, the ink tack value becomes high. Ink tack value becomes low from the middle stage to final stage of the drying process because of the reduction of solvent residing in the ink as well as the hardening of the ink. That is, in a situation where the amount of solvent in ink is large, hardening of the ink does not progress so that the ink tack value will not decrease.

In this invention, the above ink tack test is carried out to evaluate ink solvent absorption ability of a coated paper which determines the drying property during the initial stage of the drying process by the ink tack value measured 24.5 seconds after printing has been performed while evaluating ink solvent absorption ability of a coated paper which determines the drying property from the middle to final stage of the drying process by an ink tack value measured 669.6 seconds and 790.2 seconds after printing has been performed.

When the above ink tack test method is applied to a coated paper for printing of the invention, an ink tack value measured 24.5 seconds after printing is 3N or less, preferably 2.5N or less. When this value exceeds 3N, the ink solvent absorption ability of the outermost coating layer is too high for a coated paper to achieve high printing gloss.

In the meantime, ink tack value measured 790.2 seconds after printing is 4N or less, preferably 3N or less. If this value exceeds 4N, it means that the transferred ink is not dry yet and presents stickiness when it reaches the final stage of the ink drying process. Therefore, it is more preferable for a coated paper of the invention to have an ink tack value of 3N or less when measured 669.6 seconds after printing has been performed in the above ink tack test.

Evaluation of Set-Off Blot by RI Printability Tester

A transfer blot caused by a RI printability tester is similar to a set-off blot produced by sequentially stacking printed matter discharged from a printer in actual offset sheet-fed printing. Thereby, conventionally, a transfer blot caused by an RI printability tester is referred to as set-off blot here in this specification.

Evaluation of set-off blot is performed under the circumstances of 23° C. and 50 RH % as described below:

Sheet ink for paper evaluation (trade name: BESTONE SHEET BLACK INK FOR PAPER EVALUATION T&K, TOKA Co., Ltd.) is used as it is for evaluation. Using a full automatic RI printability tester (manufactured by SMT Co., Ltd., Type: PM-9005RI), full-page printing is performed on a test coated paper under the condition of printing pressure of 980N, print speed of 1.52 rpm (minimum speed), with an amount of transferred ink of 4.2±0.1 $g/m^2$. Then, a synthetic paper wound around a transfer roll comes in contact with a type page of the test coated paper under the pressure of 0.392 MPa (4.0 $Kgf/cm^2$) while elapsed time after printing is changed. In this instance, rotational speed of the above transfer roll is set at 1.52 rpm (minimum speed).

Next, the level of ink adhesion to the above synthetic paper is scanned as image data by a digital scanner, and the level of ink adhesion is numerically evaluated for the brightness of 256 gradation with an image analysis program (trade name: DA6000, Oji Scientific Instruments). The thus obtained value is indicated as set-off density in this invention.

Similar to the ink tack test method, the drying property of the ink transferred onto a coated paper can be evaluated over time by tracing the change of set-off density after printing has been performed. The value of set-off density is inversely proportional to the amount of solvent residing in the transferred ink onto a coated paper, that is, the amount of solvent which is not yet absorbed into a coating layer. In other words, if the amount of un-absorbed solvent is large, the brightness value becomes low and if the amount of un-absorbed solvent is small, the brightness value becomes high.

In this invention, the above set-off blot evaluation is carried out to evaluate ink solvent absorption ability of a coated paper which determines the drying property during the initial stage of the drying process by set-off density measured 1 minute after printing has been performed while evaluating ink solvent absorption ability of a coated paper which determines the drying property during the middle stage of the drying process by set-off density measured 3 minutes after printing has been performed. Similarly, ink solvent absorption ability of a coated paper which determines the drying property during the final stage of the drying process is evaluated by set-off density measured 6 minutes after printing has been performed.

When an evaluation for set-off blot is carried out for a coated paper of the invention by the above RI printability tester, set-off density measured 1 minute after printing is 30 or less, preferably 28 or less. When this value exceeds 30, the ink solvent absorption ability of the outermost coating layer is too high for a coated paper to achieve high printing gloss.

In the meantime, set-off density measured 6 minutes after printing is 230 or greater, preferably 245 or greater. If this value is less than 230, it means that transferred ink is not dry yet and presents stickiness when it reaches the final stage of the ink drying process. Therefore, it is more preferable for a coated paper of the invention to have set-off density of 200 and higher when measured 3 minutes after printing has been performed in the above set-off density evaluation test.

In a coated paper for printing of the invention, the solvent of the transferred ink is absorbed by the outermost coating layer in the early stage of the drying process while the solvent of the transferred ink is absorbed by an inner coating layer provided under the outermost layer in the middle stage and thereafter. Therefore, the drying rate of the ink transferred to a paper surface can be slow in the initial stage of the drying process and can be fast in the final stage of the drying process so that the inventive coated paper can achieve high printing gloss with a desired print efficiency when applied to an offset sheet-fed printing.

Although such a coated paper can be produced by applying at least two coating layers containing pigment components and adhesive components on at least one surface of a base paper, it is preferable for the outermost coating layer and inner coating layer abutted on this outermost layer to comprise as follows:

Outermost Coating Layer

Pigment components of the outermost coating layer comprise calcium carbonate having an average particle diameter within a range of 0.3-1.2 μm of 5-70 mass % and kaolin having an average diameter within a range of 0.1-0.4 μm of 30-95 mass %. It is preferable for calcium carbonate to have a mixing ratio of 70 mass % or less as the increase of the mixing ratio of calcium carbonate will degrade the paper gloss of a coated paper.

Unlike conventional procedures in which the ink settability of the outermost coating layer is controlled by adjusting a void diameter of the coating layer, according to a coated paper of the invention, the ink settability can be controlled by a type and amount of adhesive components used in the outermost layer.

Adhesive components of the outermost coating layer comprise (a) water soluble adhesive, (b) styrene-butadiene copolymer latex containing acrylonitrile of 10-35 mass % in the ratio of monomer and having an average diameter of 50-120 nm, and (c) copolymer latex other than the above (b), wherein when an amount of each of the above (a), (b), and (c) contained in the coating layer is denoted as (S) mass parts, (L1) mass parts, and (L2) mass parts based on 100 mass parts of pigment components of the coating layer, respectively, the value of A can be obtained by the following equation:

$$A(\text{mass part})=2\times(S)+1.5\times(L1)+1\times(L2)$$

Wherein, $0\leqq(S)<6$, $0\leqq(L1)$, $0\leqq(L2)$, $$(S)+(L1)+(L2)\leqq 16$$

wherein when an amount of pigment components having an average particle diameter of 0.4 μm or less contained in the outermost layer is (i) 60 mass % or less of the total amount of pigment components, the value of A is within a range of 16-21, (ii) more than 60 mass % of the total amount of pigment components, the value of A is within a range of 19-24.

A water soluble adhesive (a) may include a variety of starches such as oxidized starch, esterified starch, or cold water soluble starch, proteins such as casein, soybean albumin, or synthetic protein, cellulose derivatives such as carboxymethyl cellulose or methyl cellulose, polyvinyl alcohol and its degeneration. Copolymer latex (c) may include styrene-butadiene copolymer latex having an average diameter less than 50 nm or more than 120 nm, conjugate diene polymer latex of methyl methacrylate-butadiene copolymer, acrylic polymer latex, ethylene-vinyl acetate copolymer or the like.

When three components used for adhesive components of the outermost coating layer are compared in the same amount, respectively, a water soluble adhesive (a) has a greater effect of lowering the ink settability of the outermost coating layer compared with copolymers (b) and (c), in which the copolymer (b) has a greater effect compared with the copolymer (c). Therefore, all the adhesive components of the coating layer can be either (b) or (c) within a range that does not exceed 16 mass parts based on 100 parts of pigment components of the coated layer. However, when the adhesive (a) is used, the amount must be less than 6 mass parts. If 6 mass parts or more is used, there is a risk of degrading the whiteness and gloss of a coated paper. In addition, when the total amount of the above three components exceeds 16 mass parts based on 100 mass parts of pigment components of the outermost coating, it is impossible for the outermost coating layer to be given desirable ink settability.

When pigment components contained in the outermost coating layer have an average particle diameter of 0.4 μm and are of 60 mass % or less based on a total amount of pigment components contained in the outermost layer wherein a value of the above (A) deviates from the range of 16-21, desirable ink settability cannot be provided for the outermost layer.

When a ratio of such pigment components exceeds 60 mass % and a value of the above (A) deviates from the range of 19-24, it is also impossible for the outermost coating layer to be given desirable ink settability.

Inner Coating Layer

Pigment components of an inner coating layer comprise calcium carbonate having an average particle diameter of 0.1-1.2 μm and an amount of 80-100 mass % of pigment components of the inner coating layer. The amount of adhesive components of the inner coating layer is within a range of 6-13 mass parts based on 100 mass parts of the above pigment components. One or more kinds of adhesives normally used in a coating layer can be used as these adhesive components. However, when a water soluble adhesive is used, the amount must be less than 6 mass parts based on 100 mass parts of pigment components.

One or more types of pigment components are used in an inner coating layer in an amount of less than 20 mass % of pigment components of the inner coating, which include talc, amorphous silica, zinc oxide, aluminium oxide, aluminium hydroxide, satin white, silicate aluminium, magnesium silicate, magnesium carbonate, titanium dioxide, plastic pigments or the like. However, similar to calcium carbonate, when any of those pigments is used, it is preferable to use the one having an average particle diameter of 0.1-1.2 μm. It is because the use of pigments having an average diameter that deviates from this range causes undesirable ink settability in a coated paper.

With regard to an adhesive component of the inner coating layer, the use of either of the afore-mentioned (b) or (c) is preferable.

As needed, the aforementioned outermost layer and inner coating layer can suitably include a variety of auxiliaries such as a dye or color pigment of blue or purple color system, fluorescent dye, thickener, water retention agent, antioxidant, age resistor, conductive finishing agent, antifoaming agent, UV absorbing agent, dispersant, pH controlling agent, mold release agent, water resistant agent, or water-repellent agent.

Although there is no particular limitation for a base paper of a coated paper of the invention, a basis weight of a base paper is approximately 30-300 g/m$^2$ in general. Before applying an inner coating and the outermost coating layer to a base paper, a size treatment may be performed by using a natural adhesive such as starch or a synthetic adhesive such as polyvinyl alcohol. A preliminary coating may be applied using a coating mixture mainly composed of a pigment and adhesive.

The method and apparatus normally employed in preparation of a coated paper can be used when an inner coating layer and the outermost coating layer are applied at least on one surface of a base paper. A coating mixture capable of forming the above explained inner coating and outermost coating layer are prepared, respectively. When an inner coating layer is formed, the application amount of a coating mixture is within a range of 5-20 g/m$^2$ per one surface after the coated mixture has dried. When the outermost coating layer is formed, the application amount of a coating mixture is within a range of 2-15 g/m$^2$, preferably, 5-10 g/m$^2$ per one surface after the coated mixture has dried. Each coating mixture is prepared and coated by a normal method and dried. It is preferable for the amount of coating mixture applied to the outermost coating layer not to exceed that applied to the inner coating layer after the coated mixture has dried.

During a finish process of the outermost coating layer, a smoothing treatment is applied using machine calender, super calender, gloss calender, soft calender or the like so as to regulate the smoothness of the coating layer within a range of 300-13000 sec. according to Oken type smoothness. If the smoothness increases too much, there is a risk of the coating layer having undesirable ink settability.

A coated paper for printing of the invention can be suitably used not only for off-set printing but also for flexo printing or photogravure in which an ink with low viscosity is used as it can provide a speedy ink drying property and good printing finish.

EXAMPLES

Although the present invention will be explained below in detail by way of examples, it is not intended to limit the invention to those scopes. The "parts" and "%" shown in examples indicate "part(s) by mass" and "mass %" unless otherwise specified.

Furthermore, an average particle diameter of pigments and latex are measured pursuant to the following method:

Average Particle Diameter of Pigments

Distributed processing was performed on pigments in liquid of 0.1% sodium pyrophosphate for five minutes by ultrasonic wave, which was then measured by a sedimentation method using SEDI GRAPH 5100 (Micromeritics, Co. Ltd.). A particle diameter at the point where an accumulated mass from a coarse particle corresponds to 50% was shown as an average particle diameter.

Average Particle Diameter of Copolymer Latex (Dispersion Liquid Type Adhesive)

Copolymer latex was processed with osmium acid and then its picture was taken by a transmission electron microscope with magnification ×50000. A particle diameter of approximately 200 copolymer latex was measured from the thus obtained pictures so as to calculate the average.

Example 1

Preparation of Base Paper

To a pulp slurry consisting of 90 parts of LBKP (freeness 440 ml/csf) and 10 parts of NBKP (freeness 510 ml/csf), light calcium carbonate was added as a filler to have the paper ash of 10% based on pulp solid content. Furthermore, 0.05% of AKD sizing agent (trade name: SIZEPINE K-902, Arakawa Chemicals Co., Ltd.) and 0.5% of aluminium sulfate were added as an internal sizing agent in preparation. The thus prepared mixture was passed through a hybrid type twin wire paper machine, and dried to obtain a base paper (raw paper). Subsequently, oxidized starch gelatinized liquid (trade name: ACE A, Oji Cornstarch Co., Ltd.) having the concentration of 6% was applied to the thus obtained base paper to be 1.4 g/m$^2$ in terms of solid matter per both side surfaces through a two-roll size press device and dried so as to obtain a base paper having a basis weight of 75 g/m$^2$.

Preparation of Coating Mixture for Outermost Coating Layer

A slurry of pigment was prepared by dispersing a pigment consisting of 40 mass % of heavy calcium carbonate having an average particle diameter of 0.8 μm (trade name: HYDROCARB 90, Bihoku Funka Kogyo Co., Ltd.) and 60 mass % of fine kaolin having an average particle diameter of 0.3 μm (trade name: MIRAGLOSS, Engelhard Corporation, USA) into water by a coarse dispersion apparatus. To the above pigment slurry, 11 parts of styrene-butadien copolymer latex L1 having an average particle diameter of 95 nm and containing acrylonitrile monomer content of 21 mass % based on 100 parts of pigment (trade name: PA2323, Nippon A & L, Inc.), 0.5 part of oxidized starch liquid (trade name: ACE B, Oji Cornstarch Co., Ltd.), (both in terms of solid matter), an antifoaming agent, and dye or the like were added so that a coating mixture having a solid matter concentration of 64% was finally prepared.

Preparation of Coating Mixture for Inner Coating Layer Adjacent to Outermost Layer To a slurry pigment consisting of 100 mass % of heavy calcium carbonate having an average particle diameter of 0.8 μm (trade name: HYDROCARB 90, Bihoku Funka Kogyo Co., Ltd.), 8 parts of styrene-butadien copolymer latex L2 having an average particle diameter of 125 nm and containing acrylonitrile monomer content of 17 mass % based on 100 parts of pigment (trade name: T-2629M, Nippon JSR Corporation), 1 part of oxidized starch liquid (trade name: ACE B, Oji Cornstarch Co., Ltd.), (both in terms of solid matter), an antifoaming agent, and dye or the like were added so that a coating mixture having a solid matter concentration of 64% was finally prepared.

Preparation of Coated Paper for Printing

The aforementioned coating mixture for an inner coating layer was applied to both sides of the above base paper with a blade coater to be 10 g/m$^2$ per side surface after the coating mixture was dried so as to provide an undercoat (inner coating layer). Then, the above coating mixture for the outermost coating layer was applied to each of both surfaces of the paper with a blade coater to have a coating amount of 10 g/m$^2$ per side surface after the coating mixture was dried. After the coating mixture was dried, a paper both sides coated twice was obtained with the moisture of 5.0%. The thus obtained coated paper was passed through a super calender to obtain a coated paper for printing.

Example 2

Example 1 was repeated to produce a sheet of coated paper except for the use of 6 parts of styrene-butadien copolymer latex L2 (trade name: T-2629M, Nippon JSR Corporation) and 4 parts of oxidized starch liquid (trade name: ACE B, Oji Cornstarch Co., Ltd.) in preparation of a coating mixture for an inner coating layer.

Example 3

Example 1 was repeated to produce a sheet of coated paper except that 11 parts of styrene-butadien copolymer latex L1 (trade name: PA2323, Nippon A & L, Inc.) and 0.5 part of oxidized starch liquid (trade name: ACE B, Oji Cornstarch Co., Ltd.) were replaced with 6 parts of styrene-butadien copolymer latex L1 (trade name: PA2323, Nippon A & L, Inc.), 8 parts of styrene-butadien copolymer latex L2 (trade name: T-2629M, Nippon JSR Corporation), and 0.5 part of oxidized starch liquid (trade name: ACE B, Oji Cornstarch Co., Ltd.) in preparation of coating mixture for the outermost coating layer.

Example 4

Example 1 was repeated to produce a sheet of coated paper except that 11 parts of styrene-butadien copolymer latex L1 (trade name: PA2323, Nippon A & L, Inc.) and 0.5 part of oxidized starch liquid (trade name: ACE B, Oji Cornstarch Co., Ltd.) were replaced with 12 parts of styrene-butadien copolymer latex L1 (trade name: PA2323, Nippon A & L, Inc.) and 0.5 part of oxidized starch liquid (trade name: ACE B, Oji Cornstarch Co., Ltd.) in preparation of coating mixture for the outermost coating layer, and that heavy calcium carbonate having an average particle diameter of 0.8 μm (trade name: HYDROCARB 90, Bihoku Funka Kogyo Co., Ltd.) was replaced with 100 mass % of fine heavy calcium carbonate having an average particle diameter of 0.37 μm (trade name: SETACARB HG, Bihoku Funka Kogyo Co., Ltd.) and no oxidized starch liquid (trade name: ACE B, Oji Cornstarch Co., Ltd.) was used in preparation of coating mixture for an inner coating layer.

Example 5

Example 4 was repeated to produce a sheet of coated paper except that the coating amount applied to an inner coating layer changed to 14 g/m$^2$ per side surface after the coating mixture was dried while a coating amount applied to the outermost coating layer changed to 6 g/m$^2$ per side surface after the coating mixture was dried.

Example 6

Example 1 was repeated to produce a sheet of coated paper except that 11 parts of styrene-butadien copolymer latex L1 (trade name: PA2323, Nippon A & L, Inc.) and 0.5 part of oxidized starch liquid (trade name: ACE B, Oji Cornstarch Co., Ltd.) were replaced with 10 parts of styrene-butadien copolymer latex L2 (trade name: T-2629M, Nippon JSR Corporation) and 4 parts of oxidized starch liquid (trade name: ACE B, Oji Cornstarch Co., Ltd.) in preparation of a coating mixture for the outermost coating layer.

Example 7

Example 1 was repeated to produce a sheet of coated paper except that the amount of heavy calcium carbonate having an average particle diameter of 0.8 μm (trade name: HYDROCARB 90, Bihoku Funka Kogyo Co., Ltd.) changed to 10 mass %, the amount of fine kaolin having an average particle diameter of 0.3 μm (trade name: MIRAGLOSS, Engelhard Corporation, USA) changed to 90 mass %, and 11 parts of styrene-butadien copolymer latex L1 (trade name: PA2323, Nippon A & L, Inc.) and 0.5 part of oxidized starch liquid (trade name: ACE B, Oji Cornstarch Co., Ltd.) were replaced with 14 parts of styrene-butadien copolymer latex L1 (trade name: PA2323, Nippon A & L, Inc.) in preparation of a coating mixture for the outermost coating layer.

Example 8

Example 1 was repeated to produce a sheet of coated paper except that the amount of heavy calcium carbonate having an average particle diameter of 0.8 μm (trade name: HYDROCARB 90, Bihoku Funka Kogyo Co., Ltd.) changed to 60 mass %, the amount of fine kaolin having an average particle diameter of 0.3 μm (trade name: MIRAGLOSS, Engelhard Corporation, USA) changed to 40 mass %, and 11 parts of styrene-butadien copolymer latex L1 (trade name: PA2323, Nippon A & L, Inc.) and 0.5 part of oxidized starch liquid (trade name: ACE B, Oji Cornstarch Co., Ltd.) were replaced with 11 parts of styrene-butadien copolymer latex L1 (trade name: PA2323, Nippon A & L, Inc.) in preparation of a coating mixture for the outermost coating layer.

Example 9

Example 1 was repeated to produce a sheet of coated paper except that the amount of oxidized starch liquid (trade name:

ACE B, Oji Cornstarch Co., Ltd.) changed to 4 parts in preparation of coating mixture for the inner coating layer.

Example 10

Example 1 was repeated to produce a sheet of coated paper except that the amount of styrene-butadien copolymer latex L1 having an average particle diameter of 95 nm (trade name: PA2323, Nippon A & L, Inc.) changed to 5 parts, and 6 parts of styrene-butadien copolymer latex L1 having an average particle diameter of 105 nm (trade name: PA2327, Nippon A & L, Inc.) were added in preparation of a coating mixture for the outermost coating layer.

Example 11

Example 1 was repeated to produce a sheet of coated paper except that the amount of heavy calcium carbonate having an average particle diameter of 0.8 μm (trade name: HYDROCARB 90, Bihoku Funka Kogyo Co., Ltd.) changed to 70 mass %, and 30 mass % of heavy calcium carbonate having an average particle diameter of 1.2 μm were added in preparation of a coating mixture for the inner coating layer.

Comparative Example 1

Example 1 was repeated to produce a sheet of coated paper except that the amount of styrene-butadien copolymer latex L2 (trade name: T-2629M, Nippon JSR Corporation) changed to 4 parts, and an amount of oxidized starch liquid (trade name: ACE B, Oji Cornstarch Co., Ltd.) changed to 7 parts in preparation of a coating mixture for the inner coating layer.

Comparative Example 2

Example 1 was repeated to produce a sheet of coated paper except that 11 parts of styrene-butadien copolymer latex L1 (trade name: PA2323, Nippon A & L, Inc.) and 0.5 part of oxidized starch liquid (trade name: ACE B, Oji Cornstarch Co., Ltd.) were replaced with 11 parts of styrene-butadien copolymer latex L2 (trade name: T-2629M, Nippon JSR Corporation) and 0.5 part of oxidized starch liquid (trade name: ACE B, Oji Cornstarch Co., Ltd.) in preparation of a coating mixture for the outermost coating layer.

Comparative Example 3

Comparative Example 2 was repeated to produce a sheet of coated paper except that the amount of c styrene-butadien copolymer latex L2 (trade name: T-2629M, Nippon JSR Corporation) changed to 4 parts, and the amount of oxidized starch liquid (trade name: ACE B, Oji Cornstarch Co., Ltd.) changed to 7 parts in preparation of a coating mixture for the inner coating layer.

Comparative Example 4

Example 1 was repeated to produce a sheet of coated paper except that 11 parts of styrene-butadien copolymer latex L1 (trade name: PA2323, Nippon A & L, Inc.) and 0.5 part of oxidized starch liquid (trade name: ACE B, Oji Cornstarch Co., Ltd.) were replaced with 10 parts of styrene-butadien copolymer latex L2 (trade name: T-2629M, Nippon JSR Corporation) and 2 parts of oxidized starch liquid (trade name: ACE B, Oji Cornstarch Co., Ltd.) in preparation of a coating mixture for the outermost coating layer.

Comparative Example 5

Example 1 was repeated to produce a sheet of coated paper except that 11 parts of styrene-butadien copolymer latex L1 (trade name: PA2323, Nippon A & L, Inc.) and 0.5 part of oxidized starch liquid (trade name: ACE B, Oji Cornstarch Co., Ltd.) were replaced with 10 parts of styrene-butadien copolymer latex L2 (trade name: T-2629M, Nippon JSR Corporation) and 6 parts of oxidized starch liquid (trade name: ACE B, Oji Cornstarch Co., Ltd.) in preparation of a coating mixture for the outermost coating layer.

Comparative Example 6

Example 1 was repeated to produce a sheet of coated paper except that 11 parts of styrene-butadien copolymer latex L1 (trade name: PA2323, Nippon A & L, Inc.) and 0.5 part of oxidized starch liquid (trade name: ACE B, Oji Cornstarch Co., Ltd.) were replaced with 18 parts of styrene-butadien copolymer latex L2 (trade name: T-2629M, Nippon JSR Corporation) in preparation of a coating mixture for the outermost coating layer.

Comparative Example 7

Example 1 was repeated to produce a sheet of coated paper except that the amount of heavy calcium carbonate having an average particle diameter of 0.8 μm (trade name: HYDROCARB 90, Bihoku Funka Kogyo Co., Ltd.) changed to 80 mass %, the amount of fine kaolin having an average particle diameter of 0.3 μm (trade name: MIRAGLOSS, Engelhard Corporation, USA) changed to 20 mass %, and 11 parts of styrene-butadien copolymer latex L1 (trade name: PA2323, Nippon A & L, Inc.) and 0.5 part of oxidized starch liquid (trade name: ACE B, Oji Cornstarch Co., Ltd.) were replaced with 11 parts of styrene-butadien copolymer latex L1 (trade name: PA2323, Nippon A & L, Inc.) in preparation of a coating mixture for the outermost coating layer.

Comparative Example 8

Example 1 was repeated to produce a sheet of coated paper except that the amount of heavy calcium carbonate having an average particle diameter of 0.8 μm (trade name: HYDROCARB 90, Bihoku Funka Kogyo Co., Ltd.) changed to 10 mass %, the amount of fine kaolin having an average particle diameter of 0.3 μm (trade name: MIRAGLOSS, Engelhard Corporation, USA) changed to 90 mass %, and 11 parts of styrene-butadien copolymer latex L1 (trade name: PA2323, Nippon A & L, Inc.) and 0.5 part of oxidized starch liquid (trade name: ACE B, Oji Cornstarch Co., Ltd.) were replaced with 11 parts of styrene-butadien copolymer latex L1 (trade name: PA2323, Nippon A & L, Inc.) in preparation of a coating mixture for the outermost coating layer.

The quality of each coated paper for printing obtained by the above Examples and Comparative Examples was evaluated according to the following method, and the results are shown in Table 1.

Evaluation was carried out at temperature 23° C. and under the condition of 50 RH % unless otherwise specified.

Absorption Coefficient Ka of Coated Paper for Printing According to Bristow Method Absorption coefficient Ka was measured pursuant to J. TAPPI Paper Pulp Test Method No. 51 using Bristow tester (Bristow type liquid dynamic absorption tester, Kumagaya Riki Kogyo Co., Ltd.). Standard viscosity oil defined in JIS Z-8809 (JS 2.5) was used as evaluation liquid to substitute for solvent in ink. Correlation of square value between the transferred amount of evaluation liquid V (m1/m2) and contact time (millisecond) obtained during the contact time of 198-1998 ms was depicted so as to calculate absorption coefficient Ka from a slope of a line thus obtained.

Ink Tack Evaluation of Coated Paper for Printing

Ink tack evaluation of a coated paper for printing was conducted using an ink tack test apparatus (trade name: ISIT MARK IV, Segan Inc.). Test ink prepared by mixing 80 mass % of sheet ink for paper evaluation (trade name: BESTONE SHEET BLACK INK FOR PAPER EVALUATION T&K, TOKA Co., Ltd.) and 20 mass % of ink solvent (trade name: HIZ REDUCER, Dainippon Ink and Chemicals Inc.) was used for the evaluation.

The thus prepared test ink was mixed by an ink mixing unit of the aforementioned test apparatus under the condition of 10 m/min for three minutes. Then, this ink was adhered to a print disc for one minute. Next, full page printing was performed on a sample coated paper fixed to a metal drum of the test apparatus under the condition of print speed of 0.5 m/s, printing pressure of 100 N, and an amount of ink adhesion of 2.3±0.1 g/m$^2$ using the print disc to which the test ink was adhered. The amount of ink adhesion was calculated from the difference of the print disc weight before and after the full page printing.

When a predetermined time elapsed after the full page printing, a rubber blanket was made to come in contact with the typeface and maintained for three seconds in such a manner as to apply pressure of level 8, which corresponds to "strong"; said applied pressure is adjustable to eight levels between 1-8. Then, the rubber blanket was detached from the typeface of the sample coated paper at level 2 which corresponds to "high", which is adjustable to eight levels of detach speed to measure tack value at the time the rubber blanket was detached from the typeface.

A tack value was measured once immediately after the full page printing, and thereafter, measured three times every 20 seconds, three times every 70 seconds, three times every 90 seconds, and three times every 120 seconds, which results in a total number of 13 measurements (measurement time: 15 minutes) to record change in the tack value over elapsed time.

The measurement of the ink tack value which changes as time elapses was performed with a same sample coated paper three times, which included measurement when the elapsed time was 24.5 seconds after the full page printing (second measurement), 669.6 seconds after the printing (11$^{th}$ measurement), and 790.2 seconds after the printing (12$^{th}$ measurement) so as to measure the mean of the ink tack values.

Evaluation of Set-Off Blot by R1 Printability Tester

For evaluating set-off blot, a fully automatic RI printability tester (trade name: PM-9005RI TYPE, SMT Co., Ltd.) was used. As test ink, sheet ink for paper evaluation (trade name: BESTONE SHEET BLACK INK FOR PAPER EVALUATION T&K, TOKA Co., Ltd.) was used as it is.

A sample coated paper prepared to have a size of 1 cm or longer in breadth and 20 cm in length was adhered to a board art (trade name: OK TOKU ART POST 256 g/m$^2$, Oji Paper Co., Ltd.), and the board art was then fixed to an impression cylinder of the RI printability tester. In the meantime, a synthetic paper (trade name: UPO FPG-80 74 g/m$^2$, Upo Corporation) was wound around a transfer roll of the printer. Next, the test ink (1.0 cc) was distributed to an ink distributing roller, mixed with an ink mixing pressure of 0.392 MPa for 90 seconds. Immediately after this process, full page printing was conducted onto a sample coated paper with a printing pressure of 980 N (100 kgf) and a printing speed (rotational speed of an impression cylinder) of 1.52 rpm so as to have an amount of ink adhesion of 4.2 ±0.1 g/m$^2$. Then, the transfer roll to which the synthetic paper was wound came in contact with a typeface under the condition of a pressure of 0.392 MPa (4.0 kgf/cm$^2$) and transfer speed (rotational speed of an impression cylinder) of 1.52 rpm so as to transfer ink to the synthetic paper. In this case, the interval between the time when printing was performed onto a sample coated paper and the time when a synthetic paper came into contact with its typeface was changed from immediately after printing to 1 minute later, 3 minutes later, and 6 minutes later. As a result, three synthetic papers with ink blots were obtained in which ink was left on a sample coated paper for different lengths of time before it was transferred to a synthetic paper, respectively.

After each of the synthetic papers with ink blot was stationarily dried at room temperature for 24 hours, the blots on the papers were captured as digital data by a digital scanner (trade name: EPSON GT5500WINS, Seiko Epson Corporation). The condition for scanning was as follows:

Mode: white and black photography, Resolution: 2400 dpi, Exposure: 0, Gamma: 100, High Light: 245, Shadow: 3, Contour Enhancement: 0, Density Correction: Linear, Gray Balance: 0, Chroma: 0, Color Filter (R, G, B): 0, Measuring Region: 7 mm×7 mm Next, the scanned data of each ink blot was processed using an image analysis apparatus (trade name: DA6000, Oji Scientific Instruments) so that the level of ink blot was evaluated as a value on a density of 256 gradation.

This operation was repeated three times using a same sample coated paper, and the density obtained each time was averaged to obtain set-off density of the interval length 1 minute, 3 minutes, and 6 minutes, respectively. The results are shown in table 1 as set-off density.

Other characteristics of each coated paper obtained by Examples 1-10 and Comparative Examples 1-8 not mentioned in the foregoing are shown in Table 2. The Evaluation method for characteristics shown in Table 2 is as follows:

Whiteness and Gloss of Coated Paper

Whiteness and gloss was measured for both sides of each coated paper using a gloss meter (Model: GM-26D, Murakami Color Research Laboratory Co., Ltd.) pursuant to TAPPI Test Method: T 480 om-92 so as to obtain the mean.

Smoothness of Coated Paper

Smoothness was measured for both sides of each coated paper using an Oken type smoothness pursuant to J. TAPPI Paper Pulp Test Method No. 5B so as to obtain the mean.

Reverse Printing Capable Time by Offset Sheet Single-Sided Printer (Time)

Single-sided four-color printing was performed at a speed of 8000 sheets/hour with process ink using MITSUBISHI DIA 4E-4 printer. Elapsed time before commencing printing on the other side varied from 30 minutes, to 1 hour, 1.5 hours, 2 hours, and 3 hours since one side had been printed so as to determine idle time for the printer to print the other side without scratching the previously printed surface.

Printing Gloss

60° gloss of the four-color full page printed parts of the previously printed surface for measuring reverse printing capable time by an offset sheet printer was measured pursuant to JIS Z8741 to obtain the mean.

Printing Density

Printing density of the four-color full page printed parts of the previously printed surface for measuring reverse printing capable time by an offset sheet printer was measured on a 10-point scale using a color densitometer (trade name: X-RITE 404G, X-Rite Co., Ltd.) with Visual mode pursuant to obtain the mean.

Printing Gloss (Sensory Evaluation)

Level of printing gloss of the four-color full page printed parts of the previously printed surface for measuring reverse printing capable time by an offset sheet printer was visually sensory evaluated in accordance with the following scales:

Four Points: Excellent and superior in both printing gloss and printing density

Three Points: Excellent in both printing gloss and printing density

Two Points: Slightly deficient in both printing gloss and printing density

One Point: Deficient in both printing gloss and printing density

Printability Evaluation by Offset Double-Sided Sheet Printer

Using non-skin type ink (T & K, Toka Co., Ltd.), degree of ink accumulation on an impression cylinder of the final eighth color and a degree of figure deficiency after 5000 sheets were printed at the speed of 10000 sheets/hour by an eight-color two-sided sheet printer (Heidelberg.) was evaluated in accordance with the following four scales:

○: Slight ink accumulation on an impression cylinder, but no deficiency in printed matter Δ: Considerable ink accumulation on an impression cylinder, but no deficiency in printed matter x: Considerable ink accumulation on an impression cylinder, and dot-like missing spots in printed matter

TABLE 1

| | Bristow Absorption Coefficient | Ink Tack Value | | | Set-off Density | | | Value of Formula 1 |
|---|---|---|---|---|---|---|---|---|
| | | 24.5 Sec | 669.6 Sec | 790.2 Sec | 1 Min. | 3 Min. | 6 Min. | |
| Example 1 | 0.14 | 2.6 | 3.8 | 3.2 | 26 | 225 | 247 | 17.5 |
| Example 2 | 0.13 | 2.3 | 5.2 | 3.8 | 24 | 214 | 238 | 17.5 |
| Example 3 | 0.12 | 2.6 | 4.0 | 3.5 | 27 | 223 | 243 | 18 |
| Example 4 | 0.10 | 2.1 | 2.2 | 1.6 | 16 | 233 | 251 | 19 |
| Example 5 | 0.10 | 2.4 | 1.8 | 1.1 | 21 | 238 | 253 | 19 |
| Example 6 | 0.09 | 2.1 | 4.3 | 3.8 | 22 | 208 | 237 | 18 |
| Example 7 | 0.05 | 2.7 | 3.8 | 3.3 | 28 | 210 | 250 | 21 |
| Example 8 | 0.15 | 2.2 | 5.2 | 3.8 | 20 | 204 | 241 | 16.5 |
| Example 9 | 0.13 | 2.4 | 5.6 | 3.8 | 25 | 210 | 234 | 17.5 |
| Example 10 | 0.16 | 2.8 | 3.2 | 2.9 | 27 | 228 | 249 | 17.5 |
| Example 11 | 0.14 | 2.6 | 4.0 | 3.6 | 25 | 212 | 240 | 17.5 |
| Com. Exm 1 | 0.13 | 2.2 | 6.1 | 6.0 | 18 | 192 | 226 | 17.5 |
| Com. Exm 2 | 0.16 | 5.2 | 2.3 | 1.7 | 69 | 234 | 253 | 12 |
| Com. Exm 3 | 0.15 | 5.0 | 3.2 | 2.2 | 48 | 218 | 243 | 12 |
| Com. Exm 4 | 0.10 | 3.3 | 3.9 | 3.5 | 32 | 221 | 247 | 14 |
| Com. Exm 5 | 0.07 | 1.8 | 5.7 | 5.2 | 11 | 181 | 228 | 22 |
| Com. Exm 6 | 0.06 | 1.8 | 6.3 | 5.8 | 12 | 174 | 224 | 18 |
| Com. Exm 7 | 0.38 | 1.9 | 5.8 | 4.7 | 7 | 168 | 218 | 16.5 |
| Com. Exm 8 | 0.05 | 3.7 | 2.2 | 1.7 | 45 | 235 | 252 | 18 |

TABLE 2

| | Whiteness and Gloss | Printing Gloss | Printing Density | Printing Gloss (Sensory Evaluation) | Reverse Printing Capable Time (H.) | Smoothness | Printability of Both-Sided Printer |
|---|---|---|---|---|---|---|---|
| Example 1 | 79 | 79 | 2.56 | 3 | 1 | 4900 | ○ |
| Example 2 | 78 | 80 | 2.60 | 3.5 | 1.5 | 5200 | ○ |
| Example 3 | 75 | 79 | 2.57 | 3 | 1.5 | 5400 | ○ |
| Example 4 | 77 | 81 | 2.61 | 4 | 0.5 | 5400 | ○ |
| Example 5 | 77 | 80 | 2.58 | 3.5 | 0.5 | 5500 | ○ |
| Example 6 | 73 | 80 | 2.58 | 3.5 | 1.5 | 4800 | ○ |
| Example 7 | 82 | 79 | 2.57 | 3 | 1 | 5600 | ○ |
| Example 8 | 75 | 80 | 2.60 | 3.5 | 1.5 | 5200 | ○ |
| Example 9 | 76 | 80 | 2.60 | 3.5 | 1.5 | 4900 | ○ |
| Example 10 | 79 | 79 | 2.56 | 3 | 1 | 5200 | ○ |
| Example 11 | 76 | 79 | 2.58 | 3 | 1.5 | 4800 | ○ |
| Com. Exm 1 | 76 | 82 | 2.63 | 4 | 3 | 6900 | ○ |
| Com. Exm 2 | 79 | 74 | 2.50 | 1 | 0.5 | 4500 | x |
| Com. Exm 3 | 76 | 78 | 2.53 | 2 | 1 | 6200 | x |
| Com. Exm 4 | 75 | 76 | 2.54 | 2 | 1 | 5200 | Δ |
| Com. Exm 5 | 70 | 80 | 2.60 | 3.5 | 3 | 4400 | ○ |
| Com. Exm 6 | 69 | 80 | 2.63 | 3.5 | 3 | 4600 | ○ |
| Com. Exm 7 | 67 | 78 | 2.60 | 3 | 3 | 5100 | ○ |
| Com. Exm 8 | 83 | 72 | 2.51 | 1 | 0.5 | 5500 | x |

What is claimed is:

1. A coated paper for printing applying two or more coating layers composed mainly of a pigment and an adhesive on at least one surface of a base paper, wherein pigment components of the outermost layer is composed of calcium carbonate of 5-70 mass % having an average particle diameter of 0.3-1.2 μm and kaolin of 30-95 mass % having an average particle diameter of 0.1-0.4 μm, and adhesive components of the outermost layer is composed of (a) water soluble adhesive, (b) styrene-butadiene copolymer latex containing acrylonitrile of 10-35 mass % in the ratio of monomer and having an average diameter of 50-120 nm, and (c) copolymer latex and other than the above (b), wherein when an amount of each fo the above (a), (b), and (c) contained in the coating layer is denoted as (S) mass parts, (LI) mass parts, and (L2) mass parts based on 100 mass parts of pigment components of the coating layer, respectively, the value of A can be obtained by the following equation:

$$A(\text{mass part})=2\times(S)+1.5\times(L1)+1\times(L2)$$

Wherein, $0\leqq(S)<6$, $0\leqq(L1)$, $0\leqq(L2)$, $(S)+(L1)+(L2)\leqq 16$

Wherein the amount of pigment components having an average particle diameter of 0.4 μm or less contained in the outermost layer is (i) 60 mass% or less of the total amount of pigment components, the value of A is within a range of 16-21, (II) more than 60 mass % of the total amount of pigment components, the value of A is within a range of 19-24, wherein 80-100 mass% of pigment components of an inner coating layer abutting on the outermost coating layer is composed of calcium carbonate having an average particle diameter of 0.1-1.2 μm while the mixture amount of adhesive components of the coating layer is 6-13 mass parts based on 100 mass parts of pigment components and the amount of water soluble adhesive contained in adhesive components is less than 6 mass parts based on 100 mass parts of pigment components.

2. A coated paper for printing as defined in claim 1, wherein ink tack value measured 24.5 seconds after printing has been performed is 2.5N or less and ink tack value measured 790.2 seconds after printing has been performed is 4N or less.

3. A coated paper for printing as defined in claim 1, wherein ink tack value measured 24.5 seconds after printing has been performed is 2.5N or less, ink tack value measured 669.6 seconds after printing has been performed is 3N or less and ink tack value measured 790.2 seconds after printing has been performed is 3N or less.

4. A coated paper as defined in claim 1, wherein absorption coefficient Ka of the coating layers is within the range of 0.02-0.35 ml/($m^2$-$ms^{1/2}$) when measured using Bristow tester and standard viscosity oil (JS2.5) defined in JIS Z8809-1992 as evaluation liquid, and wherein set-off density measured by a RI printability tester after printing on the coated paper with sheet ink for evaluating paper on condition that printing pressure is 980N and the amount of transferred ink is 4.2±0.1 g/$m^2$is evaluated with a 256 gradation, the set-off density 1 minute after printing is 30 or less and the set-off density 6 minutes after printing is 230 or greater.

5. A coated paper for printing as defined in claim 4, wherein the set-off density 1 minute after printing is 30 or less and the set-off density 6 minutes after printing is 245 or greater.

6. A coated paper for printing as defined in claim 4, wherein the set-off density 1 minute after printing is 30 or less, 3 minutes after printing is 200 or greater, and 6 minutes after printing is 245 or greater.

7. A coated paper for printing as defined in claim 4, wherein the set-off density 1 minute after printing is 28 or less, 3 minutes after printing is 200 or greater, and 6 minutes after printing is 245 or greater.

8. A coated paper defined in claim 1, wherein absorption coefficient Ka of the coating layers is within a range of 0.02-0.35 ml/($m^2$-$ms^{1/2}$) when measured using Bristow tester and standard viscosity oil (JS2.5) defined in JIS Z8809-1992 as evaluation liquid, wherein ink is a blend of sheet ink for evaluating paper of 80 mass % and ink solvent of 20 mass % printed on the coating layers on condition that printing pressure is 100N and the amount of transferred ink is 2.3±0.1 g/$m^2$, wherein the maximum value of ink tack is between 24.5 seconds and 790.2 seconds after printing has been performed, wherein ink tack value measured 24.5 seconds after printing has been performed is 3N or less and ink tack value measured 790.2 seconds after printing has been performed is 4N or less.

* * * * *